US011801418B2

(12) United States Patent
Hammer

(10) Patent No.: US 11,801,418 B2
(45) Date of Patent: Oct. 31, 2023

(54) FITNESS EQUIPMENT, IN PARTICULAR WEIGHT BENCH

(71) Applicant: HAMMER SPORT AG, Neu-Ulm (DE)

(72) Inventor: Markus Hammer, Gräfelfing (DE)

(73) Assignee: HAMMER SPORT AG, Neu-Ulm (DE)

( * ) Notice: Subject to any disclaimer, the term of this patent is extended or adjusted under 35 U.S.C. 154(b) by 112 days.

(21) Appl. No.: 17/497,762

(22) Filed: Oct. 8, 2021

(65) Prior Publication Data

US 2022/0126161 A1 Apr. 28, 2022

(30) Foreign Application Priority Data

Oct. 28, 2020 (EP) ..... 20 204 483

(51) Int. Cl.
*A63B 21/00* (2006.01)
*A63B 23/12* (2006.01)

(52) U.S. Cl.
CPC ..... *A63B 21/4029* (2015.10); *A63B 23/1218* (2013.01); *A63B 21/4035* (2015.10)

(58) Field of Classification Search
CPC ..... A63B 21/4029; A63B 23/1218; A63B 21/4035; A63B 2210/50; A63B 2225/093; A63B 1/00; A63B 21/0004; A63B 21/068; A63B 23/1227
See application file for complete search history.

(56) References Cited

U.S. PATENT DOCUMENTS

| | | | | |
|---|---|---|---|---|
| 4,456,248 | A | 6/1984 | Smith | |
| 4,638,995 | A | 1/1987 | Wilson | |
| 5,261,868 | A | 11/1993 | Pryor, Jr. et al. | |
| 10,226,662 | B1 * | 3/2019 | Mink | A63B 17/00 |
| 2003/0004042 | A1 | 1/2003 | Burrell | |
| 2014/0200123 | A1 | 7/2014 | Placide | |
| 2017/0340916 | A1 * | 11/2017 | Gennusa | A63B 1/00 |
| 2019/0126122 | A1 * | 5/2019 | Vester | A63B 71/0036 |

FOREIGN PATENT DOCUMENTS

DE 202014003263 U1 7/2014

* cited by examiner

*Primary Examiner* — Andrew S Lo

(57) ABSTRACT

The invention relates to a fitness equipment, in particular to a weight bench. The structure of the weight bench allows for a stable horizontal and vertical positioning of the weight bench. In a horizontal position, the weight bench can be used for exercises weights. In a vertical position, the weight bench can be used for pull-up exercises.

17 Claims, 5 Drawing Sheets

FITNESS EQUIPMENT, IN PARTICULAR WEIGHT BENCH

The invention relates to a fitness equipment, in particular a weight bench. For example, muscular strengthening exercises for the torso as well as for arms, but also legs, can be performed by means of such a weight bench or by means of such a fitness equipment, respectively, in particular using one's own body weight.

It goes without saying that further equipment, such as, for example, weights, dumbbells, etc., can also be combined with the fitness equipment according to the invention.

Such fitness equipment, referred to as "table gym", is known from U.S. Pat. No. 9,370,678 B2.

As stated, the mentioned U.S. publication discloses a "table gym" comprising a bench or a weight bench ("bench 40"), respectively, which is supported by a support frame, which is fastened to a so-called "upright standard 30" in various positions.

While the bench permits exercises while sitting or lying, the "upright standard 30", with its so-called "pull-up bar part 35", permits a user to do pull-ups.

The construction of U.S. Pat. No. 9,370,678 B2, consisting of a weight bench and the "upright standard", must be embodied in a stable manner and thus has a relatively high dead weight. Sufficiently stable materials, which increase the production costs, are used for a stable embodiment, in particular in the fitness area.

A weight bench of this type can also be transferred into a more space-saving state or into a training state, respectively, only by means of time-consuming conversions or fold-down or collapsing, respectively.

It is thus the object of the present invention to specify a fitness equipment, in particular a weight bench, which can be produced in a more cost-efficient and more material-saving manner compared to the prior art, and which preferably prevents a cumbersome assembly and disassembly for a training or after or before the training, respectively.

This object is solved according to the invention by means of the features of the independent claim. Further advantageous embodiments are subject of the subclaims.

According to the invention, the present invention comprises a fitness equipment, in particular a weight bench.

The fitness equipment comprises a sitting and lying device comprising a first side and comprising a second side. The sitting and lying device serves for the sitting and lying of a user.

The fitness equipment further has a first standing device and a second standing device for spacing apart the sitting and lying device from a floor and for setting up the fitness equipment on the floor.

The first standing device is arranged on the first side of the sitting and lying device, and the second standing device is arranged on the second side of the siting and lying device, in order to set up the fitness equipment in a stable manner on a floor in a first setup position, in particular in a horizontal position of the sitting and lying device.

In the present description, the "floor" is preferably understood to be the surface of a room, such as a hall or a gym or a private room in an apartment or a house, on which the fitness equipment is usually set up and/or fastened at home or in the gym.

The first standing device preferably has at least one handle area for holding on for a user. In this way, a user is able to hold on to the at least one handle area in order to perform fitness exercises.

It is furthermore preferred that the second standing device is formed such that the fitness equipment can be set up in a stable manner on the floor by means of the second standing device in a second setup position, in particular in a vertical position of the sitting and lying device, whereby the at least one handle area of the first standing device in the second setup position of the fitness equipment can be used by a user of the fitness equipment to do pull-ups against the force of gravity.

The first standing device conveniently has a first section for fastening to the sitting and lying device, and a second section for setup on the floor and for doing pull-ups.

It is further beneficial when the second section comprises the at least one handle area, in particular two handle areas. A user can thus hold on to the at least one handle area by means of his hands.

In addition, it is conceivable that in the first setup position the first section and the second section, viewed in the vertical direction, are arranged one on top of the other.

The at least one handle area is advantageously formed such that in the first setup position of the sitting and lying device, it is arranged close to the floor or is formed as base for setup on the floor.

In addition or in the alternative, it is possible that the at least one handle area is formed such that in the second setup position of the sitting and lying device, it can be used as handhold for doing pull-ups.

The first standing device preferably has a shape similar to a cross section through a hat or through a deep plate for eating soup.

It is further preferred that the first standing device simulates a U-shape.

The free ends of the U-shape preferably run in opposite directions.

In addition, it is possible that the free ends, which in particular run in opposite directions, in each case form the at least one handle area.

It is also conceivable that in its relative spatial alignment to the sitting and lying device, the first standing device draws an angle of between 89 and 110 degrees, in particular a right angle. In this way, the setup of the sitting and lying device on the floor can be ensured in a secure manner.

The second standing device is conveniently formed such that in the first setup position it ensures a stable stand for lying or sitting of a user on the sitting and lying device and in the second setup position additionally a stable stand for doing pull-ups on the first standing device. A secure stand in the first setup position is preferably attained together with the first standing device, whereas in the second setup position, a secure stand is conveniently only realized by the second standing device.

It is furthermore convenient when the second standing device has at least one fastening section for connecting to the sitting and lying device, and at least one standing section for setup on the floor in different setup positions. Depending on the orientation or position, respectively, or setup position, respectively, of the fitness equipment or of the sitting and lying device, respectively, the second standing device can thus ensure a secure and stable stand.

A first standing section of the second standing device preferably provides for the first setup position for lying or sitting on the sitting and lying device or on the fitness equipment, respectively, and a second standing section of the second standing device permits the second setup position for doing pull-ups with the help of the fitness equipment.

The second standing device can thereby be formed similarly to a pair of runners of a sled, which can preferably be connected to one another.

The second standing device preferably comprises frame parts, each of which is preferably formed similarly to a runner of a sled.

It is further advantageous when each frame part forms a first standing section and a second standing section.

It is possible thereby that the two standing sections provide for different setup positions of the sitting and lying device or of the fitness equipment, respectively.

Each frame part preferably has an approximate U-shape, preferably a spread U-shape, comprising a first and a second leg, both of which are connected to one another via a web.

It can be provided thereby that the second leg forms the second standing section, and the web forms the first standing section.

It is also preferred that the second leg and the web are formed to provide for different setup positions of the sitting and lying device or of the fitness equipment, respectively. In the case in which, for example, the web touches the floor, the first setup position of the fitness equipment can be realized. If, in contrast, the second leg touches the floor, the second setup position of the fitness equipment can be realized.

The second leg preferably has a length, which is larger compared to the first leg, whereby the surface of the sitting and lying device is towered, and a larger contact or setup surface, respectively, with the floor is ensured in the second setup position.

It can furthermore be provided that the second leg of each frame part is formed such that it can be connected to a further second leg of a frame part. In this way, the second standing device can be reinforced and can thus be formed in a more stable manner.

It is also possible that each frame part has an approximate U-shape, preferably a spread U-shape, the first leg of which is arranged on an underside of the sitting and lying device, and the second leg of which is arranged on the second side of the sitting and lying device.

Advantageously, the sitting and lying device is formed in two pieces, whereby the length of the sitting and lying device and thus the length of the fitness equipment can be varied.

It is also advantageous when the sitting and lying device comprises a first part and a second part, by means of which the length of the sitting and lying device or of the fitness equipment, respectively, can be varied.

Conveniently, the sitting and lying device is formed in a telescopic manner.

The first part can preferably be formed so as to be capable of being displaced or telescoped, respectively, relative to the second part.

It can also be provided that the sitting and lying device comprises a locking mechanism, by means of which the relative position of the first and second part of the sitting and lying device can be locked.

It is furthermore possible that in the first setup position, in which the sitting and lying device is aligned in the same direction as the floor, the at least one handle area is arranged close to the floor and/or contacts the floor, so that the fitness equipment stands on the floor by means of the first standing device and spaces apart the sitting and lying device from the floor, so that a user can sit or lie thereon.

In addition or in the alternative, it is conceivable that in the second setup position, in which the sitting and lying device draws an angle of between 80 and 100 degrees, in particular a right angle, with the floor, the at least one handle area floats above the floor, whereby a user is enabled to do pull-ups on the at least one handle area.

The fitness equipment preferably has transport rollers, by means of which the location of the fitness equipment and the spatial alignment thereof can be changed easily.

It is also preferred when the transport rollers are arranged on the second standing device.

The transport rollers are preferably arranged at the transition of the second leg to the web or between the second leg and the web. By lifting the first side of the sitting and lying device, the fitness equipment can thus be displaced to a different location in a simple manner.

For sitting and lying of a user, the sitting and lying device advantageously comprises a first and a second side as well as a third and fourth side.

The sitting and lying device preferably has a rectangular surface area.

It is also advantageous when the fitness equipment is formed such that it can be easily tilted from the first setup position into the second setup position and vice versa by the user, preferably with the help of transport rollers.

The invention will be described in more detail below on the basis of an exemplary embodiment in combination with corresponding drawings, in which, in a schematic manner:

Identical reference numerals are used for identical objects in the following description.

FIG. 1 shows a spatial view onto a fitness equipment 1 according to the invention in a first setup position O1, whereas FIG. 2 shows a spatial view onto the fitness equipment 1 according to the invention in a second setup position O2.

To simplify matters, FIGS. 1 and 2 will be described jointly below.

Figure 1:
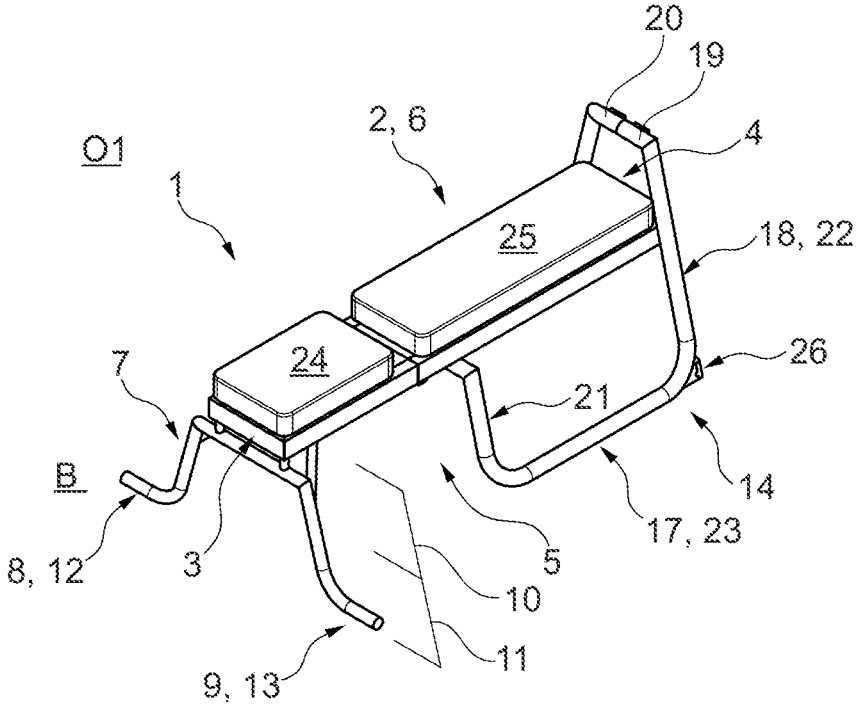
FIG. 1 shows a spatial view onto a fitness equipment according to the invention in a first setup position.
Figure 2:
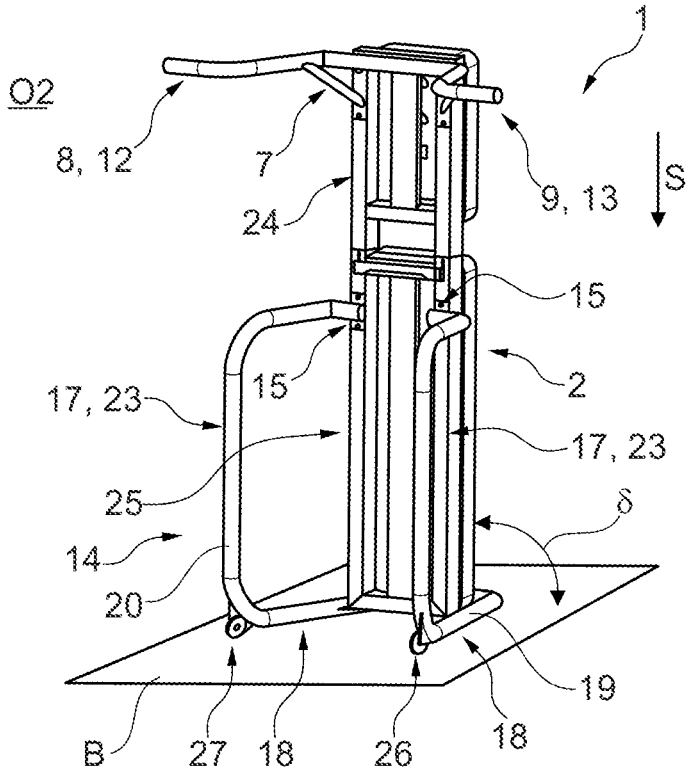
FIG. 2 shows a spatial view onto the fitness equipment according to the invention in a second setup position.

Illustrated in more detail, FIGS. 1 and 2 show a fitness equipment 1, in particular a weight bench.

The fitness bench 1 thereby has a sitting and lying device 2 for sitting and lying of a user comprising a first side 3 and comprising a second side 4.

In addition, the sitting and lying device 2 has a third 5 and fourth side 6 and, in sum, has a rectangular surface area.

The fitness bench 1 further has a first standing device 7 and a second standing device 14 for spacing apart the sitting and lying device 2 from a floor B and for setting up the fitness equipment 1 on the floor B.

As shown in FIGS. 1 and 2, the first standing device 7 is arranged on the first side 3 of the sitting and lying device 2, and the second standing device 14 is arranged on the second side 4 of the sitting and lying device 2.

As shown in FIG. 1, the fitness equipment 1 can thus be set up in a stable manner on a floor B in a first setup position O1, in particular in a horizontal position of the sitting and lying device 2.

It is furthermore illustrated in FIGS. 1 and 2 that the first standing device 7 has two handle areas 8, 9 for holding on for a user.

In addition, it can in particular be seen in FIG. 2 that the second standing device 14 is formed such that the fitness equipment 1 can be set up in a stable manner on the floor B by means of the second standing device 14 in a second setup position O2, in particular in a vertical position of the sitting and lying device 2.

The two handle areas 8, 9 of the first standing device 7 in the second setup position O2 of the fitness equipment 1 can thus be used by a user of the fitness equipment 1 to do pull-ups against the force of gravity S.

In other words, in the first setup position O1 (see FIG. 1), in which the sitting and lying device 2 is aligned in the same direction as the floor B, the handle areas 8, 9 are arranged close to the floor B or contact the floor B, respectively. The fitness equipment 1 thus stands on the floor B by means of the first standing device 7 and spaces apart the sitting and lying device 2 from the floor B, so that a user can sit or lie thereon.

In the second setup position O2 (see FIG. 2), in which the sitting and lying device 2 draws a right angle δ with the floor B, the two handle areas 8, 9 float above the floor B, whereby a user is enabled to do pull-ups on the handle areas 8, 9.

Further features of the fitness equipment 1 are described in the following description with reference to the corresponding figure.

Figure 3:
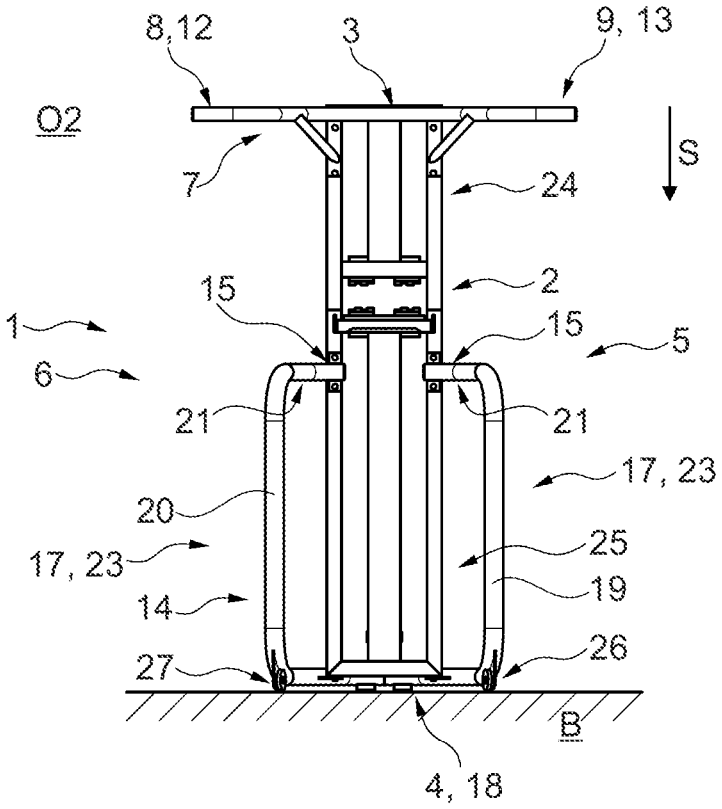
FIG. 3 shows a lower view onto the fitness equipment from FIG. 2.
Figure 4:
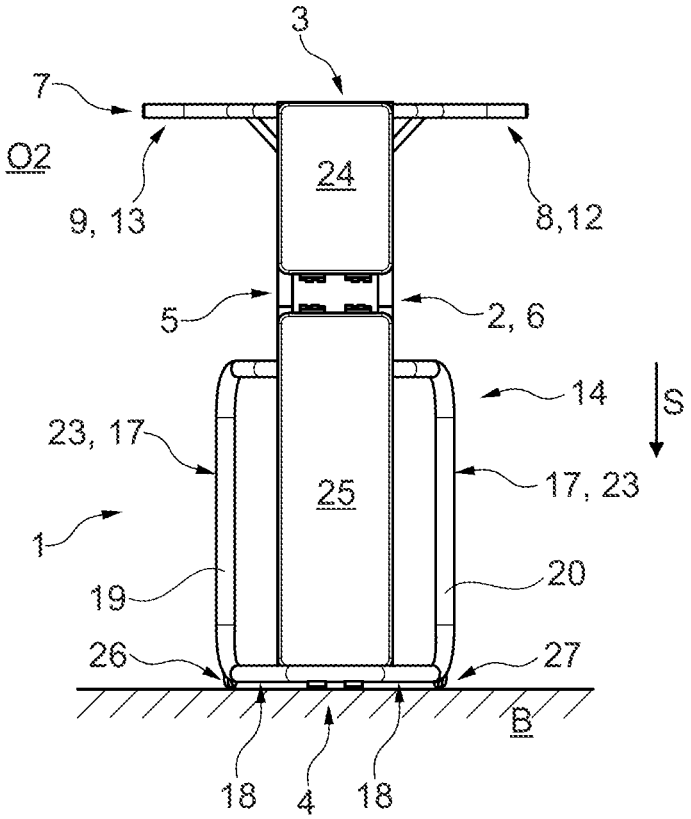
FIG. 4 shows an upper view onto the fitness equipment from FIG. 2.

FIG. 3 thereby shows a lower view onto the fitness equipment from FIG. 2, and FIG. 4 shows an upper view onto the fitness equipment from FIG. 2.

Figure 5:
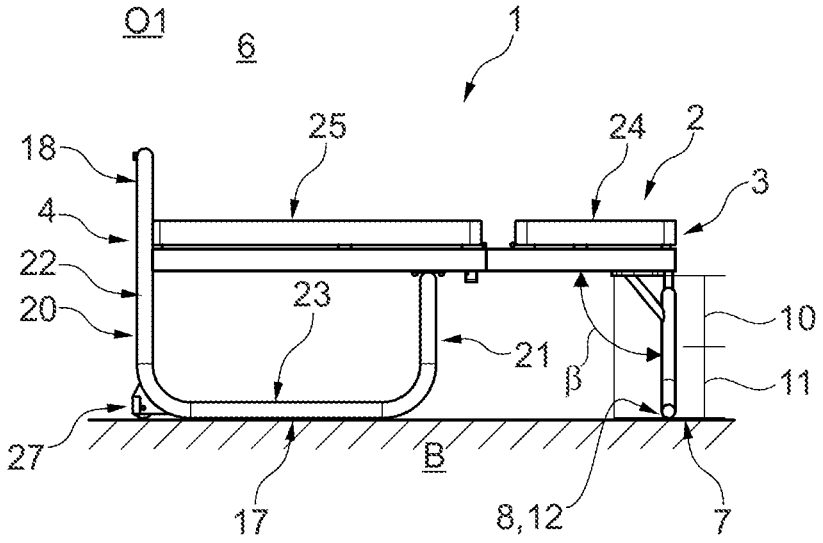
FIG. 5 shows a first lateral view onto the fitness equipment from FIG. 1.
Figure 6:
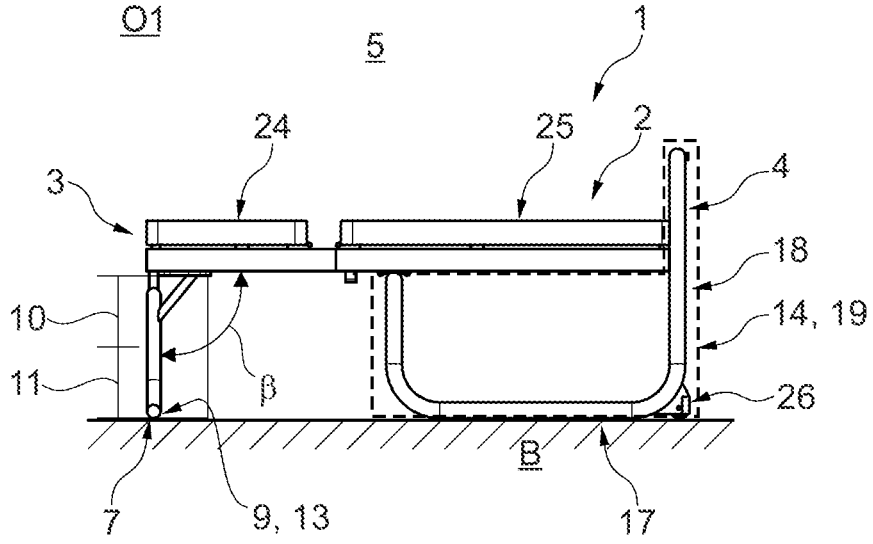
FIG. 6 shows a second lateral view onto the fitness equipment from FIG. 1.

FIGS. 5 and 6 furthermore show a first lateral view onto the fitness equipment from FIG. 1 or a second lateral view onto the fitness equipment from FIG. 1, respectively.

Figure 7:
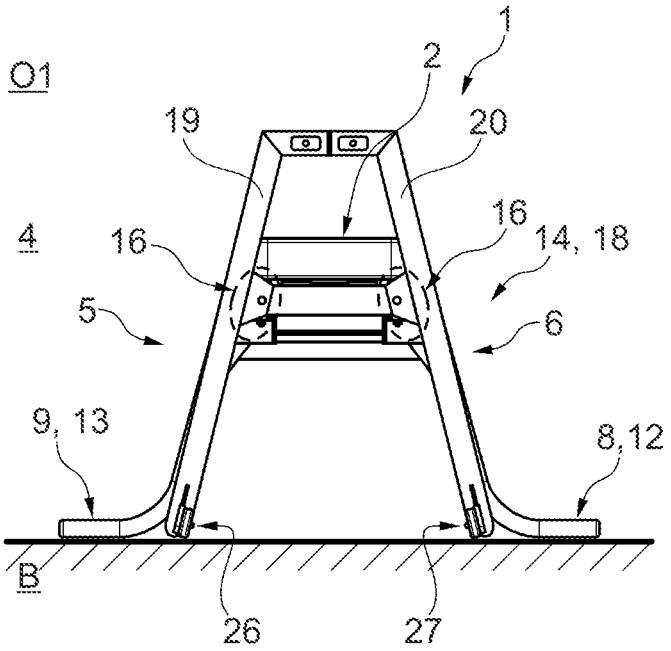
FIG. 7 shows a third lateral view onto the fitness equipment from FIG. 1.
Figure 8:
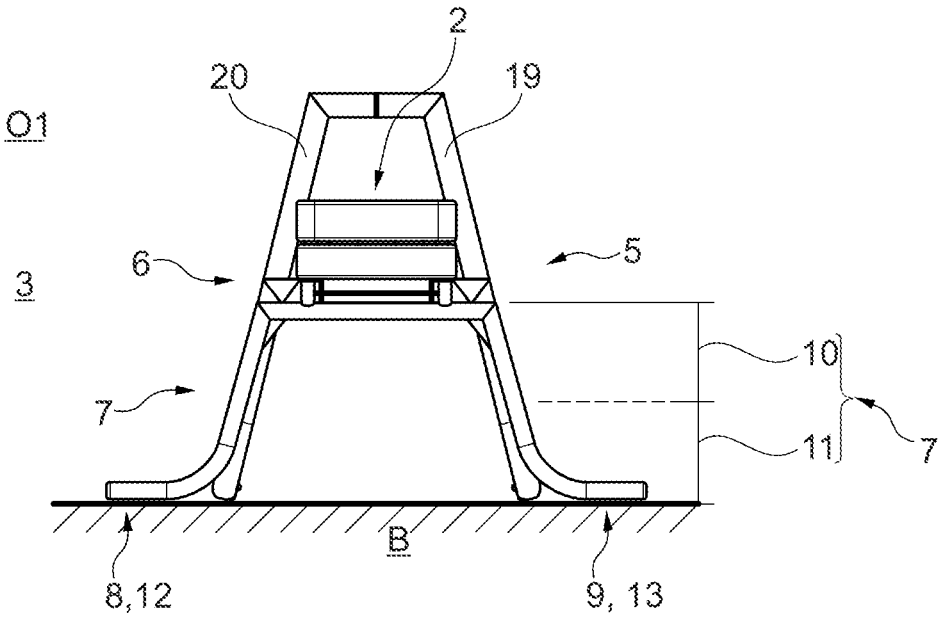
FIG. 8 shows a fourth lateral view onto the fitness equipment from FIG. 1.

FIGS. 7 and 8, in contrast, show a third lateral view and a fourth lateral view onto the fitness equipment from FIG. 1.

In the case of the corresponding features, reference is made to the corresponding figure, in which the respective feature can be seen well.

As can be seen in FIGS. 1, 5, 6, and 8, the first standing device 7 has a first section 10 for fastening to the sitting and lying device 2, and a second section 11 for setup on the floor B and for doing pull-ups.

The second section 11 thereby has the two handle areas 8, 9, wherein in the first setup position O1, the first section 10 and the second section 11, viewed in the vertical direction, are arranged one on top of the other.

As shown in FIGS. 1, 5, 6, and 8, the handle areas 8, 9 are formed such that in the first setup position O1 of the sitting and lying device 2, they are arranged close to the floor B or are formed as base for setup on the floor B.

The two handle areas 8, 9, in contrast, are also formed such that in the second setup position O2 of the sitting and lying device 2 (see FIGS. 2, 3, and 4), they can be used as handhold for doing pull-ups.

FIGS. 1 and 8 show that the first standing device 7 has a shape similar to a cross section through a hat or through a deep plate for eating soup.

In other words, the first standing device 7 simulates a U-shape, in the case of which the free ends 12, 13 run in opposite directions.

The free ends 12, 13 thereby in each case form a handle area 8, 9.

It can in particular be seen in FIGS. 5 and 6 that in its relative spatial alignment to the sitting and lying device 2, the first standing device 7 draws an angle β, in particular a right angle.

With a view to FIGS. 1, 5, 6, and 8 as well as 2, it can be seen that the second standing device 14 is formed such that in the first setup position O1 (see FIGS. 1, 5, 6, and 8), it ensures a stable stand for lying or sitting of a user on the sitting and lying device 2 and in the second setup position O2 (see FIG. 2) additionally a stable stand for doing pull-ups on the first standing device 7.

The second standing device 14 thereby has several fastening sections 15, 16 for connecting to the sitting and lying device 2, and several standing sections 17, 18 for setup on the floor B in different setup positions O1, O2 (see, for example, FIGS. 1, 3, and 7).

A first standing section 17 of the second standing device 14, which provides for the first setup position O1 for lying or sitting on the sitting and lying device 2 or on the fitness equipment 1, respectively, can be seen in FIGS. 1, 5, and 6.

A second standing section 18 of the second standing device 14 (see FIGS. 2, 4, 5, 6, and 7) permits the second setup position O2 for doing pull-ups with the help of the fitness equipment 1.

As can be seen in virtually all figures, the second standing device 14 is formed similarly to a pair of runners of a sled, which are connected to one another.

In other words, the second standing device 14 has frame parts 19, 20, each of which is formed similarly to a runner of a sled.

Each frame part 19, 20 forms a first standing section 17 and a second standing section 18, wherein, as already mentioned, the two standing sections 17, 18 provide for different setup positions O1, O2 of the sitting and lying device 2 or of the fitness equipment 1, respectively.

Described in more detail, each frame part 19, 20 thus has an approximate U-shape, preferably a spread U-shape, comprising a first and a second leg 21, 22, both of which are connected to one another via a web 23 (see in particular FIGS. 5 and 6).

The second leg 22 and the web 23 are thereby formed to provide for different setup positions O1, O2 of the sitting and lying device 2 or of the fitness equipment 1, respectively (see FIGS. 5 and 6 with FIG. 1). In other words, the second leg 22 forms the second standing section 18, and the web 23 forms the first standing section 17.

As can be seen very well in FIGS. 5 and 6, the second leg 22 has a length, which is larger compared to the first leg 21, whereby the surface of the sitting and lying device 2 is towered, and a larger contact or setup surface, respectively, with the floor B is ensured in the second setup position O2.

As illustrated in FIGS. 1, 7, and 8, among others, the second leg 22 of each housing part 19, 20 is formed such that it is connected to a further second leg 22 of a frame part 19, 20.

It can be seen on the basis of FIGS. 3, 5, and 6 that the first leg 21 of each frame part 19, 20 is arranged on the underside of the sitting and lying device 2, and the second leg 22 is arranged on the second side 4 of the sitting and lying device 2, in particular with the help of the fastening section 16 (see FIG. 7).

It can further be seen well in virtually all figures that the fitness equipment 1 is formed such that it can be easily tilted from the first setup position O1 into the second setup position O2 and vice versa by the user, for example with the help of transport rollers 26, 27.

The fitness equipment 1 thus has the transport rollers 26, 27, by means of which the location of the fitness equipment 1 and the spatial alignment thereof can be changed easily, wherein the transport rollers 26, 27 are arranged on the second standing device 14.

Described in more detail, the transport rollers 26, 27 are arranged at the transition of the second leg 22 to the web 23 or between the second leg 22 and the web 23.

Figure 9:
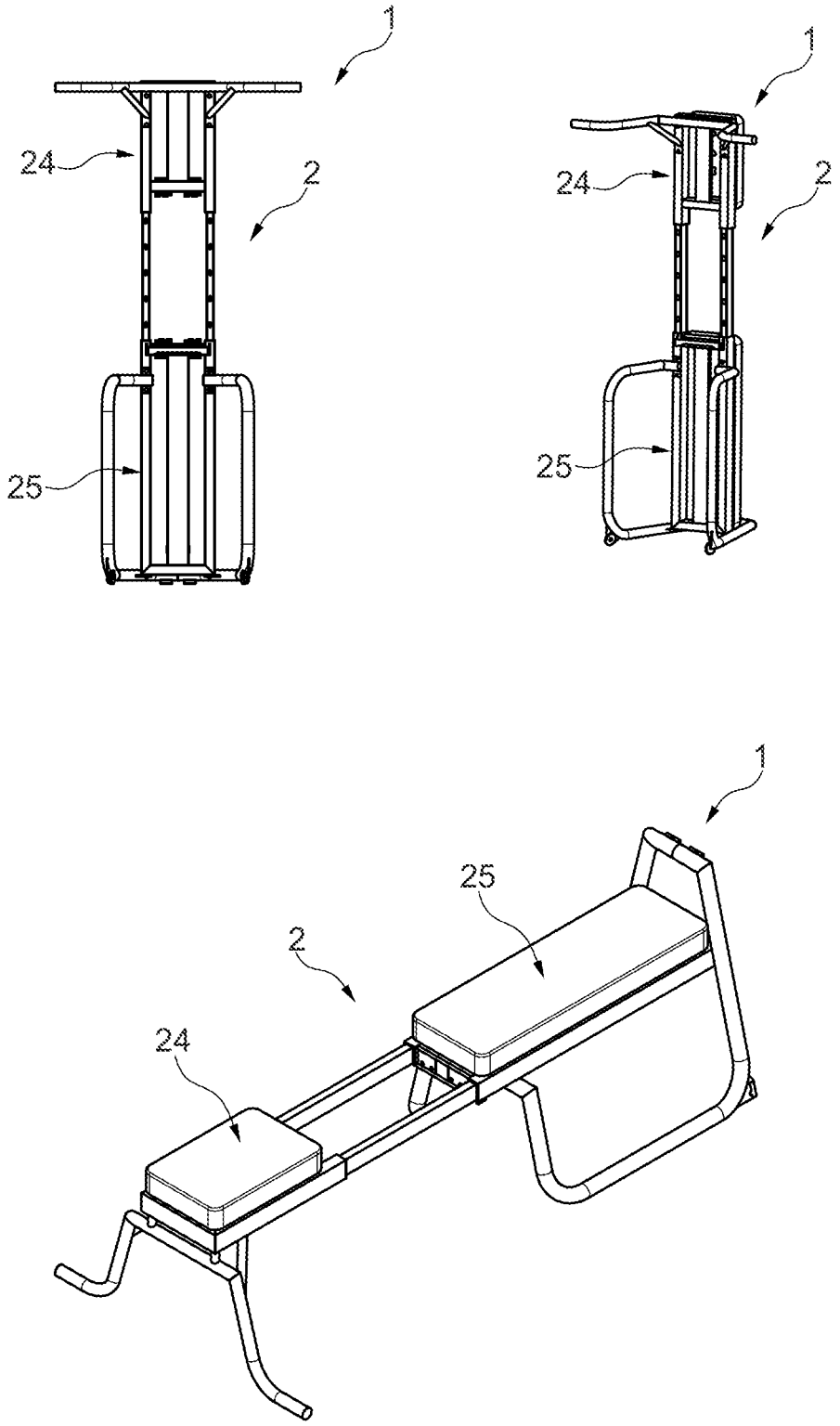
FIG. 9 shows several different spatial views onto the fitness equipment according to the invention in a lengthened state.

FIG. 9 shows several different spatial views onto the fitness equipment 1 according to the invention in a state, which is lengthened compared to FIG. 2.

As shown in all figures, the sitting and lying device 2 is thus formed in two pieces, whereby the length of the sitting and lying device 2 and thus the length of the fitness equipment 1 can be varied.

The sitting and lying device 2 thereby has a first part 24 and a second part 25, by means of which the length of the sitting and lying device 2 or of the fitness equipment 1, respectively, can be varied.

In other words, the sitting and lying device 2 is formed in a telescopic manner, wherein the first part 24 is formed so as to be capable of being displaced or telescoped, respectively, relative to the second part 25.

In addition, the sitting and lying device 2 has a locking mechanism, by means of which the relative position of the first 24 and second part 25 of the sitting and lying device 2 can be locked.

LIST OF REFERENCE NUMERALS

1 fitness equipment
2 sitting and lying device
3 first side
4 second side
5 third side
6 fourth side
7 first standing device
8 handle area
9 handle area
10 first section
11 second section
12 free end
13 free end
14 second standing device
15 fastening section
16 fastening section
17 first standing section
18 second standing section
19 frame part
20 frame part
21 first leg
22 second leg
23 web
24 first part of the sitting and lying device
25 second part of the sitting and lying device
26 transport roller
27 transport roller
B floor
S force of gravity
O1 first orientation
O2 second orientation
β angle
δ angle

The invention claimed is:

1. Fitness equipment, in particular a weight bench, having:

a sitting and lying device comprising a first side and comprising a second side for the sitting and lying of a user, a first standing device and a second standing device for spacing apart the sitting and lying device from a floor and for setting up the fitness equipment on the floor, wherein the first standing device is arranged on the first side of the sitting and lying device, and the second standing device is arranged on the second side of the siting and lying device, in order to set up the fitness equipment in a stable manner on a floor in a first setup position that is a horizontal position of the sitting and lying device, wherein the first standing device has at least one handle area for holding on for a user, and wherein the second standing device is formed such that the fitness equipment can be set up in a stable manner on the floor by the second standing device in a second setup position that is a vertical position of the sitting and lying device, whereby the at least one handle area of the first standing device in the second setup position of the fitness equipment can be used by a user of the fitness equipment to do pull-ups against the force of gravity, wherein the first standing device has a shape similar to a cross section through a hat or through a deep plate for eating soup, wherein the first standing device has a U-shape, wherein free ends of the U-shape run in opposite directions, in each case from the at least one handle area, and wherein in its relative spatial alignment to the sitting and lying device, the first standing device draws an angle of between 89 and 110 degrees.

2. The fitness equipment according to claim 1, wherein the first standing device has a first section for fastening to the sitting and lying device, and a second section for setup on the floor and for doing pull-ups, wherein the second section comprises the at least one handle area, wherein in the first setup position the first section and the second section, viewed in the vertical direction, are arranged one on top of the other.

3. The fitness equipment according to claim 1, wherein the least one handle area is formed such that in the first setup position, the at least one handle area is arranged close to the floor (B) or is formed as base for setup on the floor (B), and/or wherein in the second setup position the at least one handle area can be used as handhold for doing pull-ups.

4. The fitness equipment according to claim 1, wherein the second standing device is formed such that in the first setup position it ensures a stable stand for lying or sitting of a user on the sitting and lying device and in the second setup position additionally a stable stand for doing pull-ups on the first standing device.

5. The fitness equipment according to claim 1, wherein the second standing device has at least one fastening section for connecting to the sitting and lying device, and at least one standing section for setup on the floor in different setup positions, wherein a first standing section of the second standing device provides for the first setup position for lying or sitting on the sitting and lying device or on the fitness equipment, respectively, and a second standing section of the second standing device permits the second setup position for doing pull-ups with the help of the fitness equipment.

6. The fitness equipment according to claim 1, wherein the second standing device comprises frame parts, each of which includes a first standing section and a second standing section, wherein the two standing sections provide for different setup positions of the fitness equipment, respectively.

7. The fitness equipment according to claim 6, wherein each frame part has a spread U-shape comprising a first and a second leg, both of which are connected to one another via a web, wherein the second leg and the web provide for different setup positions of the fitness equipment, wherein the second leg is longer than the first leg, whereby a surface of the sitting and lying device is towered, and a larger contact surface with the floor is provided in the second setup position.

8. The fitness equipment according to claim 7, wherein the second leg of each frame part is formed such that it can be connected to a further second leg of another frame part, wherein each frame part has a U-shape, the first leg of which is arranged on an underside of the sitting and lying device, and the second leg of which is arranged on the second side of the sitting and lying device.

9. The fitness equipment according to claim 1, wherein the sitting and lying device comprises a first part and a second part that is movable with respect to the first part, whereby the length of the sitting and lying device and thus the length of the fitness equipment can be varied.

10. The fitness equipment according to claim 9, wherein the sitting and lying device is formed in a telescopic manner, wherein the first part of the sitting and lying device is capable of being displaced relative to the second part, wherein the sitting and lying device comprises a locking mechanism configured to lock the relative position of the first and second part of the sitting and lying device.

11. The fitness equipment according to claim 1, wherein in the first setup position, in which the sitting and lying device is aligned in the same direction as the floor, the at least one handle area is arranged close to the floor and/or contacts the floor so that the fitness equipment stands on the floor by the first standing device and spaces apart the sitting and lying device from the floor so that a user can sit or lie thereon, and/or wherein in the second setup position, in which the sitting and lying device draws an angle of between 80 and 100 degrees with the floor, the at least one handle area is raised above the floor, whereby a user is enabled to do pull-ups on the at least one handle area.

12. The fitness equipment according to claim 7, wherein the fitness equipment has transport rollers, by which the location of the fitness equipment and the spatial alignment thereof can be changed, wherein the transport rollers are arranged on the second standing device, wherein the transport rollers are arranged at the transition of the second leg to the web or between the second leg and the web.

13. The fitness equipment according to claim 1, wherein the fitness equipment is formed such that it can be easily tilted from the first setup position into the second setup position and vice versa by the user with the help of transport rollers.

14. A fitness equipment comprising:

a sitting and lying device comprising a first side and a second side for the sitting and lying of a user, a first standing device and a second standing device for spacing apart the sitting and lying device from a floor and for setting up the fitness equipment on the floor, wherein the first standing device is arranged on the first side of the sitting and lying device, and the second standing device is arranged on the second side of the siting and lying device, in order to set up the fitness equipment in a stable manner on a floor in a first setup position that is a horizontal position of the sitting and lying device, wherein the first standing device has at least one handle area for holding on for a user, and wherein the second standing device is formed such that the fitness equipment can be set up in a stable manner on the floor by the second standing device in a second setup position that is a vertical position of the sitting and lying device, whereby the at least one handle area of the first standing device in the second setup position of the fitness equipment can be used by a user of the fitness equipment to do pull-ups against the force of gravity, wherein the second standing device comprises frame parts, each of which includes a first standing section and a second standing section, wherein the two standing sections provide for different setup positions of the fitness equipment, wherein each frame part has a spread U-shape comprising a first and a second leg, both of which are connected to one another via a web, wherein the second leg and the web provide for different setup positions of the fitness equipment, wherein the second leg is longer than the first leg, whereby a surface of the sitting and lying device is towered, and a larger contact surface with the floor is provided in the second setup position.

15. A fitness equipment comprising:

a sitting and lying device comprising a first side and a second side for the sitting and lying of a user, a first standing device and a second standing device for spacing apart the sitting and lying device from a floor and for setting up the fitness equipment on the floor, wherein the first standing device is arranged on the first side of the sitting and lying device, and the second standing device is arranged on the second side of the siting and lying device, in order to set up the fitness equipment in a stable manner on a floor in a first setup position that is a horizontal position of the sitting and lying device, wherein the first standing device has at least one handle area for holding on for a user, and wherein the second standing device is formed such that the fitness equipment can be set up in a stable manner on the floor by the second standing device in a second setup position that is a vertical position of the sitting and lying device, whereby the at least one handle area of the first standing device in the second setup position of the fitness equipment can be used by a user of the fitness equipment to do pull-ups against the force of gravity, wherein the sitting and lying device comprises a first part and a second part that is movable with respect to the first part, whereby the length of the sitting and lying device and thus the length of the fitness equipment can be varied.

16. A fitness equipment comprising:

a sitting and lying device comprising a first side and a second side for the sitting and lying of a user, a first standing device and a second standing device for spacing apart the sitting and lying device from a floor and for setting up the fitness equipment on the floor, wherein the first standing device is arranged on the first side of the sitting and lying device, and the second standing device is arranged on the second side of the siting and lying device, in order to set up the fitness equipment in a stable manner on a floor in a first setup position that is a horizontal position of the sitting and lying device, wherein the first standing device has at least one handle area for holding on for a user, and wherein the second standing device is formed such that the fitness equipment can be set up in a stable manner on the floor by the second standing device in a second setup position that is a vertical position of the sitting and lying device, whereby the at least one handle area of the first standing device in the second setup position of the fitness equipment can be used by a user of the fitness equipment to do pull-ups against the force of gravity, wherein the sitting and lying device is formed in a telescopic manner in which a first part of the sitting and lying device is capable of being displaced relative to a second part, wherein the sitting and lying device comprises a locking mechanism configured to lock the relative position of the first and second part of the sitting and lying device.

17. A fitness equipment comprising:

a sitting and lying device comprising a first side and a second side for the sitting and lying of a user, a first standing device and a second standing device for spacing apart the sitting and lying device from a floor and for setting up the fitness equipment on the floor, transport rollers by which the location of the fitness equipment and the spatial alignment thereof can be changed, wherein the first standing device is arranged on the first side of the sitting and lying device, and the second standing device is arranged on the second side of the siting and lying device, in order to set up the fitness equipment in a stable manner on a floor in a first setup position that is a horizontal position of the sitting and lying device, wherein the first standing device has at least one handle area for holding on for a user, and wherein the second standing device is formed such that the fitness equipment can be set up in a stable manner on the floor by the second standing device in a second setup position that is a vertical position of the sitting and lying device, whereby the at least one handle area of the first standing device in the second setup position of the fitness equipment can be used by a user of the fitness equipment to do pull-ups against the force of gravity, wherein the second standing device comprises frame parts, each of the frame parts comprising a first leg coupled to a second leg by a web, wherein the transport rollers are arranged on the second standing device at a transition of the second leg to the web or between the second leg and the web.

* * * * *